US012708834B2

(12) United States Patent
Eberwein et al.

(10) Patent No.: US 12,708,834 B2
(45) Date of Patent: Aug. 18, 2026

(54) FRONT UNIT COMPRISING A LOWERABLE HOLDING DEVICE

(71) Applicant: Salewa Sport AG, Denges (CH)

(72) Inventors: Fabian Eberwein, Innsbruck (AT); Christoph Hofer, Fulpmes (AT)

(73) Assignee: Salewa Sport AG, Denges (CH)

( * ) Notice: Subject to any disclaimer, the term of this patent is extended or adjusted under 35 U.S.C. 154(b) by 283 days.

(21) Appl. No.: 18/517,231

(22) Filed: Nov. 22, 2023

(65) Prior Publication Data

US 2024/0165489 A1 May 23, 2024

(30) Foreign Application Priority Data

Nov. 22, 2022 (DE) ..... 102022130901.0

(51) Int. Cl.
*A63C 9/08* (2012.01)
*A63C 9/085* (2012.01)

(52) U.S. Cl.
CPC ..... *A63C 9/0807* (2013.01); *A63C 9/08514* (2013.01)

(58) Field of Classification Search
CPC . A63C 9/0807; A63C 9/08514; A63C 9/0846; A63C 2009/008; A63C 9/0053; A63C 9/08528; A63C 9/08578; A63C 9/086
See application file for complete search history.

(56) References Cited

U.S. PATENT DOCUMENTS 8,544,869 B2 * 10/2013 Lehner ..... A63C 9/08528 280/611
8,746,729 B2 * 6/2014 Convert ..... A63C 9/08528 280/615
8,936,252 B2 * 1/2015 Merino ..... A63C 9/0805 280/634

(Continued)

FOREIGN PATENT DOCUMENTS

EP 3015141 A1 * 5/2016 ..... A63C 9/0844
EP 4275770 B1 1/2025

OTHER PUBLICATIONS

European Application No. 23211473.6, Extended European Search Report, Apr. 29, 2024, 8 pages.

*Primary Examiner* — James A Shriver, II
*Assistant Examiner* — Ian Bryce Shelton
(74) *Attorney, Agent, or Firm* — Kilpatrick Townsend & Stockton LLP

(57) ABSTRACT

A front unit for a touring binding. The front unit is to be mounted on a sliding board and has a mounting surface defining a sliding board plane. The front unit includes a first holding device and second holding device. The first holding device may fix a front portion of a sliding board boot for downhill travel with the touring binding in a downhill configuration. The first holding device is set into an active position in the downhill configuration, and into a passive position in a climbing configuration. The second holding device may secure a toe portion of the sliding board boot for (Continued)

Figure 1:
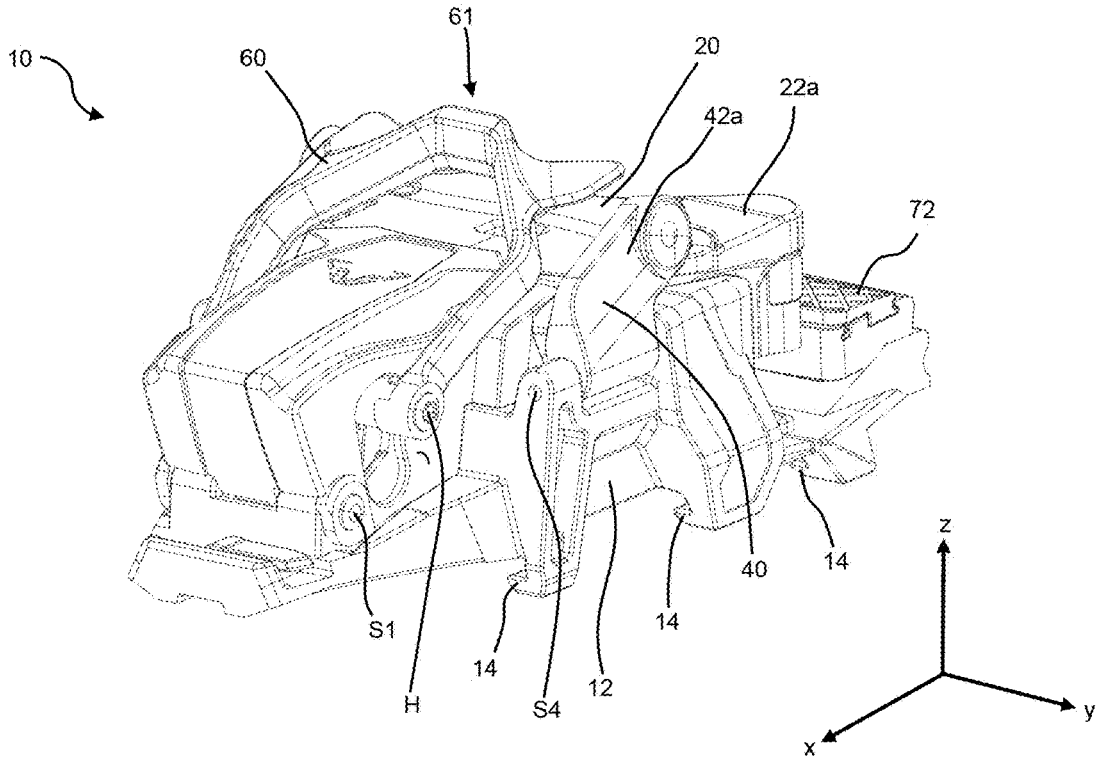

ascent with the touring binding in the climbing configuration so that the sliding board boot is pivotable about a hinge pin that is substantially in parallel with the sliding board plane and substantially perpendicular to a longitudinal axis of the sliding board.

17 Claims, 5 Drawing Sheets

(56) References Cited

U.S. PATENT DOCUMENTS

| | | | | |
|---|---|---|---|---|
| 9,039,031 | B2 * | 5/2015 | Soldan | A63C 9/0855 280/607 |
| 11,110,338 | B1 * | 9/2021 | Miller | A63C 9/06 |
| 11,173,381 | B2 * | 11/2021 | Bartl | A63C 9/08542 |
| 12,128,294 | B2 | 10/2024 | Indulti et al. | |
| 2011/0298196 | A1 * | 12/2011 | Lehner | A63C 9/0807 280/611 |
| 2014/0021696 | A1 * | 1/2014 | Soldan | A63C 9/08542 280/625 |
| 2014/0110919 | A1 * | 4/2014 | Convert | A63C 9/10 280/615 |
| 2019/0344153 | A1 * | 11/2019 | Ibach | A63C 9/08564 |
| 2020/0122016 | A1 * | 4/2020 | Bartl | A63C 9/18 |
| 2021/0308552 | A1 * | 10/2021 | Lehner | A63C 9/001 |
| 2023/0347231 | A1 | 11/2023 | Indulti et al. | |

* cited by examiner

FRONT UNIT COMPRISING A LOWERABLE HOLDING DEVICE

CROSS REFERENCE TO RELATED APPLICATION

This application claims priority to German Patent Application No. 10 2022 130901.0, filed in Germany on Nov. 22, 2022, the entire contents of which are hereby incorporated herein by this reference.

The present invention relates to a front unit for a touring binding, which front unit is to be mounted on a sliding board and has a mounting surface pointing in the direction of a sliding board surface, which mounting surface defines a sliding board plane, the front unit being adjustable between a downhill configuration and a climbing configuration, comprising a first holding device which is designed to hold a front portion of a sliding board boot for downhill travel with the touring binding, in the downhill configuration of the front unit, the first holding device being adjustable between an active position and a passive position, and the first holding device being set into the active position in the downhill configuration of the front unit, and being set into the passive position in the climbing configuration of the front unit, and a second holding device, which is designed to secure a toe portion of the sliding board boot for ascent with the touring binding in the climbing configuration of the front unit, in such a way that the sliding board boot is pivotable about a hinge pin that is substantially in parallel with the sliding board plane and substantially perpendicular to a longitudinal axis of the sliding board.

The front units addressed in the present disclosure are in particular front units of touring bindings that are to be mounted on skis. However, splitboards (snowboards that can be divided in the longitudinal direction, the halves of which can be used as touring skis) or the like are also possible as a sliding board on which a front unit according to the present invention is to be fastened, and therefore the invention also relates to front units for bindings of such sliding boards, although in the following mainly touring bindings are discussed, without limiting the subject matter of the invention.

Furthermore, it is pointed out that, within the scope of this disclosure, terms such as "top," "bottom," "above," "below," "front," "rear," "in front of," "behind," "laterally," "next to," "vertical," "horizontal," "height direction," "transverse direction," "width direction," "longitudinal direction" and the like, refer, for simplification of the illustrations, to the view of a user whose boot is coupled to the front unit mounted on the sliding board, the sliding board being arranged in a horizontal plane (the sliding board plane).

A front unit having such a first holding device is known as a front part of a downhill binding in the prior art, and generally comprises a sliding board boot holding projection which overlaps a front, protruding portion of a sliding board boot, and also lateral contact portions which contact opposite front side portions of the sliding board boot, so that the front portion of the sliding board boot is fixed to the front unit in a form-fitting manner.

In addition to the downhill binding systems described above, in the prior art front units having such a second holding device are also known, as a front part of a touring binding. Touring bindings are generally characterised by engagement means which have rotary bearing means, for pivotable mounting of the sliding board boot, at a toe portion thereof, such that an ascent is possible using a climbing skin fixed to the running surface of the sliding board. Either bearing journals which face one another and are designed to engage lateral bearing openings of a sliding board boot can be used as bearing means, so that the boot is mounted on the hinge pin defined by the bearing pin transversely to the longitudinal axis of the ski, or conversely bearing openings are provided which are engaged by pins or projections on the sliding board boot.

Sliding board bindings comprising front units, which have both a first holding device of this kind and a second holding device of this kind, are also referred to as hybrid bindings and can be used in the manner of a touring binding for ascent in the mountains, but at the same time offer optimal travel properties and stability for a descent.

A front unit of the type described at the outset is known, for example, from EP 2 626 116 A1. In the known front unit, second engagement means of a second holding device are arranged, having separate bearing means for pivotable mounting of a sliding board boot for climbing, with respect to a direction perpendicular to a sliding board plane, above or directly on first engagement means of a first holding device for fixing a front portion of the sliding board boot for a descent. This arrangement results in different coupling heights between the front unit and the sliding board boot over the sliding board plane for a descent and for climbing, in particular a significantly raised position of the sliding board boot for climbing. This arrangement entails several problems. For example, the described significantly higher boot position causes an unnatural walking sensation during climbing and, in addition, greater torques arise due to an increased lever arm, i.e., a greater distance between the sliding board and the bearing means of the second holding device, in particular in the case of transverses.

Against this background, it was an object of the present invention to develop a front unit for a touring binding, which is known in the art, in such a way that the problems defined above can be remedied, and improved functionality and user-friendliness is provided, in particular with regard to a standing height above the sliding board in a climbing configuration of the front unit, which is to be kept as low as possible.

According to a first aspect of the present invention, the object of the invention formulated above is achieved by a front unit for a touring binding, which front unit is to be mounted on a sliding board and has a mounting surface pointing in the direction of a sliding board surface, which mounting surface defines a sliding board plane, the front unit being adjustable between a downhill configuration and a climbing configuration, comprising a first holding device which is designed to fix a front portion of a sliding board boot for downhill travel with the touring binding, in the downhill configuration of the front unit, the first holding device being adjustable between an active position and a passive position, and the first holding device being set into the active position in the downhill configuration of the front unit, and being set into the passive position in the climbing configuration of the front unit, and a second holding device, which is designed to secure a toe portion of the sliding board boot for ascent with the touring binding in the climbing configuration of the front unit, in such a way that the sliding board boot is pivotable about a hinge pin that is substantially in parallel with the sliding board plane and substantially perpendicular to a longitudinal axis of the sliding board, the first holding device being arranged closer to the sliding board plane in the passive position than in the active position.

According to an important feature of the present invention, the first holding device is accordingly arranged lower, in relation to a direction perpendicular to or vertical to the sliding board plane, in the climbing configuration of the front unit than in the downhill configuration of the front unit. Assuming that the first holding device, in the downhill configuration at a distance from the sliding board plane, ensures the optimal downhill properties with regard to a standing height of the sliding board boot over the sliding board and an optimal user-friendliness, i.e., a relative distance from the sliding board plane, the fact that the first holding device is arranged closer to the sliding board plane in the passive position than in the active position, allows for the advantageous effect to be achieved that the second holding device can be arranged at a similar point as the first holding device, in the active position, such that in the climbing configuration of the front unit, when the first holding device is set into the passive position and the sliding board boot is coupled to the second holding device, a lower standing height above the sliding board can be achieved.

In particular, the first holding device can be present in the form of a conventional alpine front jaw which, however, can be lowered in any manner, and the second holding device can be present in the manner of a conventional front unit of what is know as a pin touring binding, in which projections of the front unit engage in complementarily designed recesses on the sliding board boot in order to secure it in a pivotable manner, it also being possible, vice versa, that projections on the sliding board boot engage in recesses provided correspondingly on the front unit.

It is in particular intended that the first holding device is mounted on a base of the front unit so as to be pivotable about a hinge pin that is substantially in parallel with the sliding board plane and substantially perpendicular to the sliding board longitudinal axis. It is thereby possible for the first holding device to be lowerable by a pivoting movement about this horizontal hinge pin, and thus to be adjustable from the active position into the passive position.

In a preferred embodiment of the present invention, the first holding device can comprise two clamping jaws which have contact surfaces which are designed to come into contact with a front portion of the sliding board boot, in order to securely hold the sliding board boot, when the front unit is set into the downhill configuration and the first holding device is set into the active position. In this way, a secure hold of the sliding board boot in the downhill configuration can be ensured. The clamping jaws can in each case be pivotable jointly or in particular separately about vertical axes, so that the sliding board boot can be released, for example in the event of a fall. Furthermore, the clamping jaws can comprise a holding projection which overlaps or holds down a front portion of the sliding board boot, in order to be able to fix the sliding board boot even more stably in the downhill configuration. Preferably, the clamping jaws can each have at least one contact roller for contact of the sliding board boot. Such contact rollers, known per se in the prior art, support a relative movement between the front portion of the sliding board boot and the clamping jaws, during a release of the sliding board boot in the event of a fall release. The contact rollers enable a reduction of undefined friction ratios in the contact region between the sliding board boot and the front unit, so that a release behaviour can be adjusted more precisely and reliably.

Preferably, the second holding device can also be adjustable between an active position and a passive position and can be set into the active position, in the climbing configuration of the front unit, and can be set into the passive position, in a step-in configuration of the front unit. In other words, the front unit can furthermore have a step-in configuration, by means of which it is possible for the user to couple their boot to the second holding device.

The first holding device can comprise a tread surface for a sole portion of the sliding board boot on its side facing away from the sliding board, the front unit being designed such that, by stepping onto the tread surface of the first holding device with the sole portion of the sliding board boot, the first holding device is adjusted from the active position into the passive position, and/or the second holding device is adjusted from the passive position into the active position. As a result of this configuration, an operation with regard to coupling of the sliding board boot to the second holding device is particularly simple, since the user only has to step on the tread surface of the first holding device, with the sole portion of the sliding board boot, in order to engage the sliding board boot and the second holding device.

In an advantageous embodiment of the present invention, the second holding device can comprise two arms which are pivotably mounted on a base of the front unit and which have holding means which are designed to pivotably hold the sliding board boot in the climbing configuration of the front unit, an opening angle of the arms of the second holding device relative to one another being greater in a step-in configuration of the front unit than in the downhill configuration of the front unit and/or the climbing configuration of the front unit. These holding means can in particular be projections which are designed to engage in receptacles provided on the sliding board boot, and which are preferably made of a metal material, or, vice versa, are receptacles which are designed to be engaged by projections provided on the sliding board boot. Holding means in the manner of projections are known per se in touring bindings. In particular, bearing journals having conically tapered tips which engage in corresponding opposite lateral bearing recesses of a sliding board boot are widely used. The front unit according to the invention can then be used in the climbing configuration, when the sliding board boot is held on the bearing pin, and can be used in the downhill configuration, when the first holding device immovably fixes the front portion of the sliding board boot. In the downhill configuration, the bearing journals are then in particular not in engagement with the bearing recesses of the sliding board boot.

If the second holding device comprises two arms pivotably mounted on a base of the front unit, the two arms of the second holding device can preferably be mounted on the base of the front unit so as to be pivotable about hinge pins that are substantially in parallel with the longitudinal axis of the sliding board or about hinge pins that are substantially in parallel with the sliding board plane and substantially perpendicular to the longitudinal axis of the sliding board. This pivotable mounting can be used to move the two arms of the second holding device between a closed position and an open position, which can correspond to an active position and a passive position, respectively, of the second holding device, in order to couple and decouple the sliding board boot. Alternatively or additionally, a release mechanism can be provided by the pivotable mounting of the second engagement means, which release mechanism can also ensure a fall release in the climbing configuration, and thus offers increased safety even in the event of a fall during walking.

In a further preferred embodiment of the present invention, the first holding device can be arranged further back than the second holding device, in a direction of travel in parallel with the sliding board longitudinal axis. In other words, the first holding device can accordingly be arranged closer to a heel unit of the touring binding than the second holding device. The distances between the first holding device, the second holding device and the heel unit can in this case be fixed, in an advantageous manner, in particular in such a way that a heel portion of the sliding board boot can be coupled to the heel unit in the downhill configuration of the front unit during a descent with the touring binding and, when walking with the touring binding in the climbing configuration of the front unit, is not disturbed by the heel unit.

In addition, in an advantageous embodiment of the invention, the front unit can further comprise a lever assembly which comprises an opening lever, which has an actuating portion, and a deflection mechanism, the opening lever being adjustable by means of the actuating portion between a downhill position, a step-in position, and a climbing position, and the lever assembly being designed for adjusting the front unit between the downhill configuration, a step-in configuration and the climbing configuration, by means of an adjustment of the opening lever between the downhill position, the step-in position and the climbing position. Such a lever assembly facilitates the operability of the front unit, in that the actuating portion can be operated manually or by a ski pole, in a simple manner, in order to change between the step-in position and the downhill position or the climbing position.

In a preferred embodiment, the opening lever can be mounted pivotably about a swivel pin, the pivot angle of the opening lever being at least approximately 90°, preferably at least approximately 120°, in particular at least approximately 150°. The swivel pin can in particular be arranged in parallel with the sliding board plane and perpendicular to the sliding board longitudinal axis. In this context, the pivot angle is to be understood as the angle in which lever can pivot about the swivel pin. Due to a greater pivot angle and an associated greater adjustment range of the opening lever, it is possible for the opening lever to be positioned in its different positions such that it is not disturbing for the functions of the front unit on the one hand, and, on the other hand, can be used as an indicating element for the different configurations of the front unit. For example, the opening lever can be arranged, in the step-in position, in the vicinity of a sliding board surface or can substantially rest against it, can protrude from the front unit in the climbing position and can be arranged in the vicinity of the front unit or in the vicinity of the first holding device or can substantially rest thereon in the downhill position. In this case, on the one hand the sliding board surface and, on the other hand, the first holding device, can provide a stop for the opening lever, so that the adjustment range of the opening lever is located between these two stops, whereby the pivot angle of the opening lever can be defined.

The lever assembly can advantageously also be designed to block the first holding device in the active position, in the downhill position of the opening lever. As a result, in addition to an operating function of a switchover between the step-in position and the downhill position or climbing position, the lever assembly can also have a function of stabilizing the first holding device in the active position, as a result of which the front portion of the sliding board boot can be held more stably by the first holding device in the downhill position of the opening lever and thus also in the downhill configuration of the front unit, without additional components being necessary.

In a further preferred embodiment of the present invention, the deflection mechanism can comprise a locking lever, which is in particular formed in one piece with the opening lever or is immovable in relation to the opening lever, and an adjusting lever which is connected to the opening lever and/or the locking lever and which is designed to transmit an adjusting movement of the opening lever to the second holding device, in order to effect a movement of the arms of the second holding device relative to one another, in particular to change the opening angle of the arms relative to one another, one end of the locking lever having a latching portion which is designed to come into engagement with a complementary latching portion provided on a base of the front unit, in the climbing position of the opening lever, in order to lock the second holding device in the active position, in the climbing position of the front unit, and the opening lever being mounted so as to be pivotable about a swivel pin in such a way that the latching portion is capable of pivoting in front of and behind the complementary latching portion, with respect to a direction in parallel with the sliding board longitudinal axis. In other words, the latching portion of the locking lever can pivot in both directions, beyond the latched position with the latching portion on the base. Only when a boot is coupled to the second holding device does the latching portion of the locking lever latch into the complementary latching portion on the base, in the climbing position. If, in contrast, the boot is to be coupled to the first holding device for the descent, the arms of the second holding device are located closer to one another, since they are not blocked by the boot, and the deflection mechanism causes the latching portion of the locking lever to be able to pivot beyond the latching portion on the base. That is to say that, in this embodiment, for example when the opening lever is adjusted from the step-in position into the downhill position, a movement path of the latching portion of the locking lever extends, starting in the climbing position, initially past the complementary latching portion on the base, or pivots therebeyond. Since, in this embodiment, an adjusting movement of the opening lever is transmitted to the second holding device in order to effect a movement of the arms of the second holding device relative to one another, in particular to change the opening angle of the arms, the distance between the holding means provided in each case on the arms also changes. In particular, this distance, in the step-in position of the opening lever, is greater than a width of the sliding board boot at the point to be coupled, such that the boot can be guided between the holding means 44*a*, 44*b*, and in the climbing position is somewhat smaller than the width of the sliding board boot at the point to be coupled, such that the sliding board boot is clamped firmly. In the downhill configuration of the front unit and the downhill position of the opening lever, by the movement of the opening lever, which continues further in comparison with conventional front units, beyond the latching position, the distance can advantageously be set to be so small that the sliding board boot cannot be coupled to the second holding device, but only with the first holding device, which is intended for the descent. In this way, a possibly incorrect operation of the front unit during descent, with serious consequences, can be prevented.

In a particularly preferred embodiment of the present invention, the first holding device can comprise a release mechanism having at least one resilient element, the release mechanism being designed to bias the first holding device into a holding position in which the first holding device fixes the front portion of the sliding board boot, and, when a predetermined release force acting on the first holding device is exceeded, to bring the first holding device into a release position, in which the front portion of the sliding board boot is released, in particular a spring bias of the resilient element of the release mechanism being adjustable. Such a release mechanism can in particular be a Mz release mechanism and can ensure a defined release behaviour of the first holding device in the event of a fall. Mz and My are release torques of sliding board bindings. My is the torque for release when a torque acts about a sliding board transverse axis (Y-axis), if this torque exceeds a My release torque, or the torque occurring during a forward inclination, for example a forward fall. Mz is the torque occurring during a rotation of the sliding board boot in the sliding board binding. Accordingly, a Mz safety release ensures a release of the sliding board boot from the sliding board binding when a torque acts about a Z-axis, if this torque exceeds a Mz release torque. The Z-axis extends perpendicularly to the sliding board plane. Accordingly, such a release mechanism can improve safety for the user of the front unit.

In addition, the second holding device can preferably comprise a clamping mechanism having at least one resilient element, the clamping mechanism being designed to bias the second holding device into the active position and/or into the passive position. In particular, in this case passage through a dead centre is possible, such that the second holding device is a all times biased either into the active position or into the passive position, by the clamping mechanism.

According to an advantageous variant of the invention, the front unit can further comprise a tread portion having a tread plate for a sole portion of the sliding board boot, the tread portion being mounted on a base of the front unit or on the sliding board and being designed to support the sole portion of the sliding board boot on the tread plate at a predetermined height above the sliding board plane, in particular the tread plate being designed to move in a direction substantially in parallel with the sliding board plane and substantially perpendicular to the sliding board longitudinal axis in the case of a lateral release of the first holding device. Such a lateral deflection of the tread plate advantageously leads to less friction occurring between the sole portion of the sliding board boot and the portion of the front unit on which the sole portion of the sliding board boot is supported, when the lateral release (Mz release) occurs. As a result, the lateral release (Mz release) can take place in a better defined manner.

If the front unit comprises a tread portion having a tread plate, the tread plate can thus preferably be height-adjustable in such a way that a distance between the tread plate and the sliding board plane can be changed. A variable distance between the sliding board plane and the tread plate of the tread portion allows the front unit to be adapted for different sole profiles or sole thicknesses. This is desirable since considerable differences are possible in this respect, in particular between boots for alpine use and touring boots, and the front unit according to the invention is intended to have optimal properties for both fields of application. For example, alpine ski boots are almost completely free of a profile sole, whereas in the case of touring ski boots, by which certain passages, for example in steep terrain, are navigated on foot with the skis on the back, profile soles are useful, and are also used in the vast majority of cases. An adjustment of a height of the tread plate above the sliding board plane can take place in a relatively simple manner, for example by means of an adjusting screw, the height of the tread plate being able to be adjusted by a rotation of the screw.

According to a second aspect of the present invention, the object of the invention formulated at the outset is achieved by a touring binding comprising a front unit according to the first aspect of the present invention, a heel unit, and optionally a brake assembly.

Figure 2:
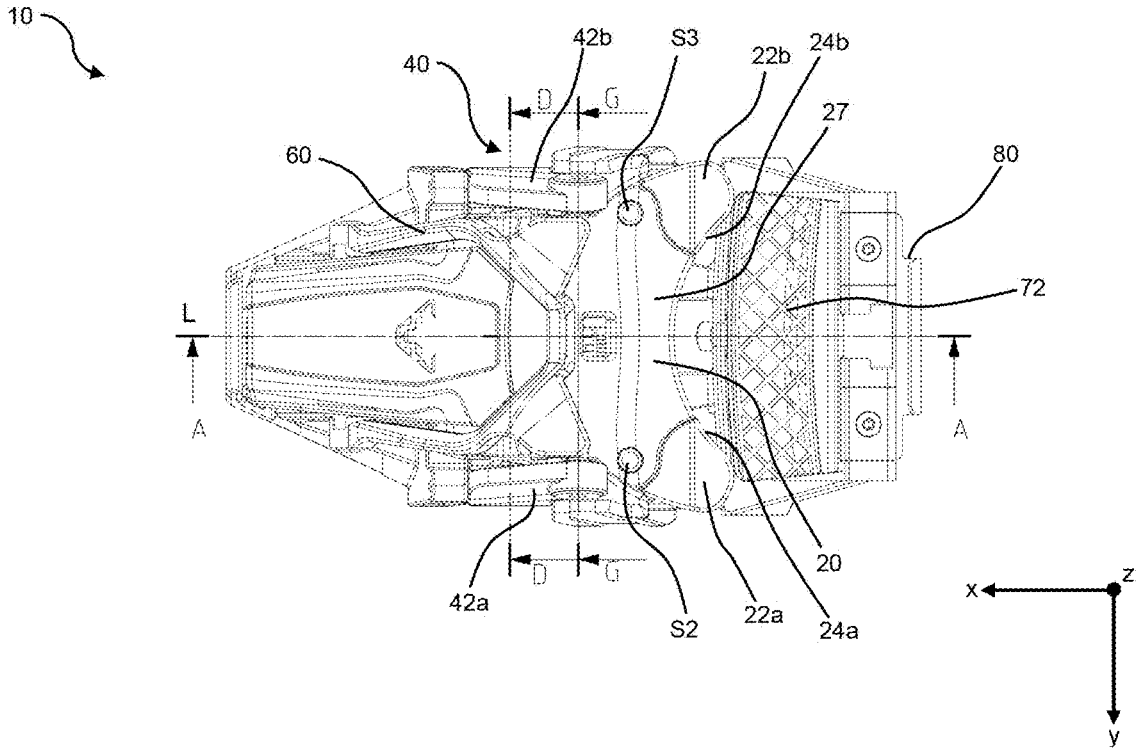
Figure 3:
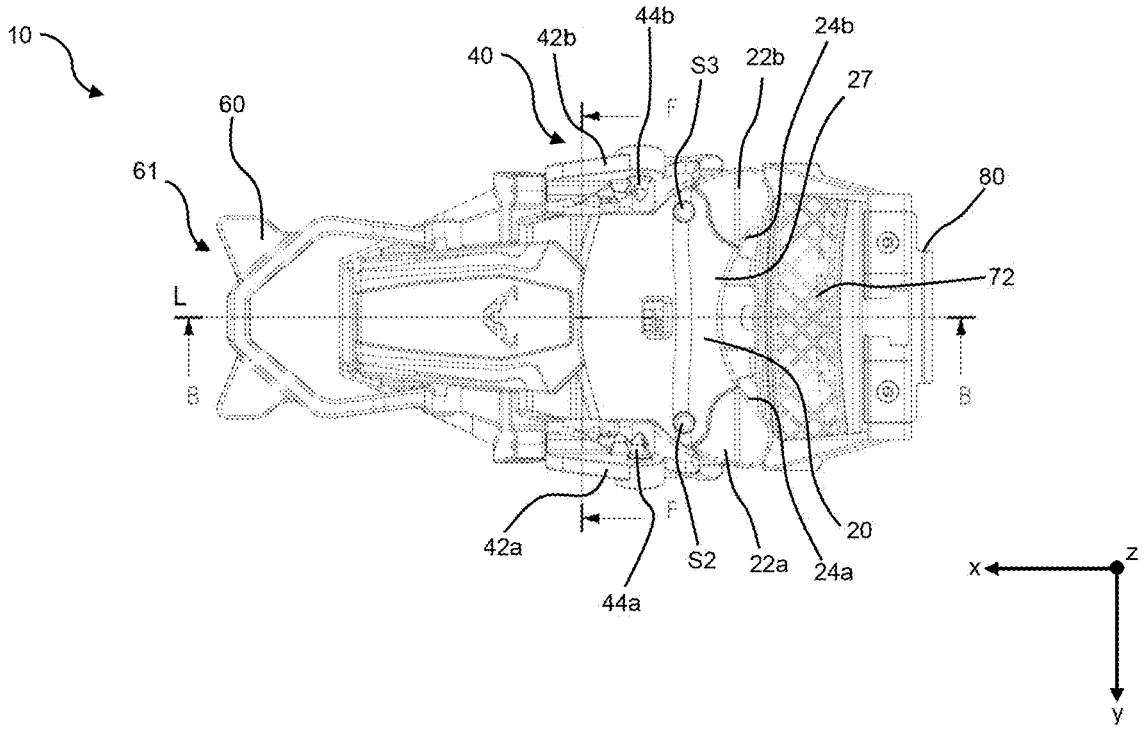
Figure 4:
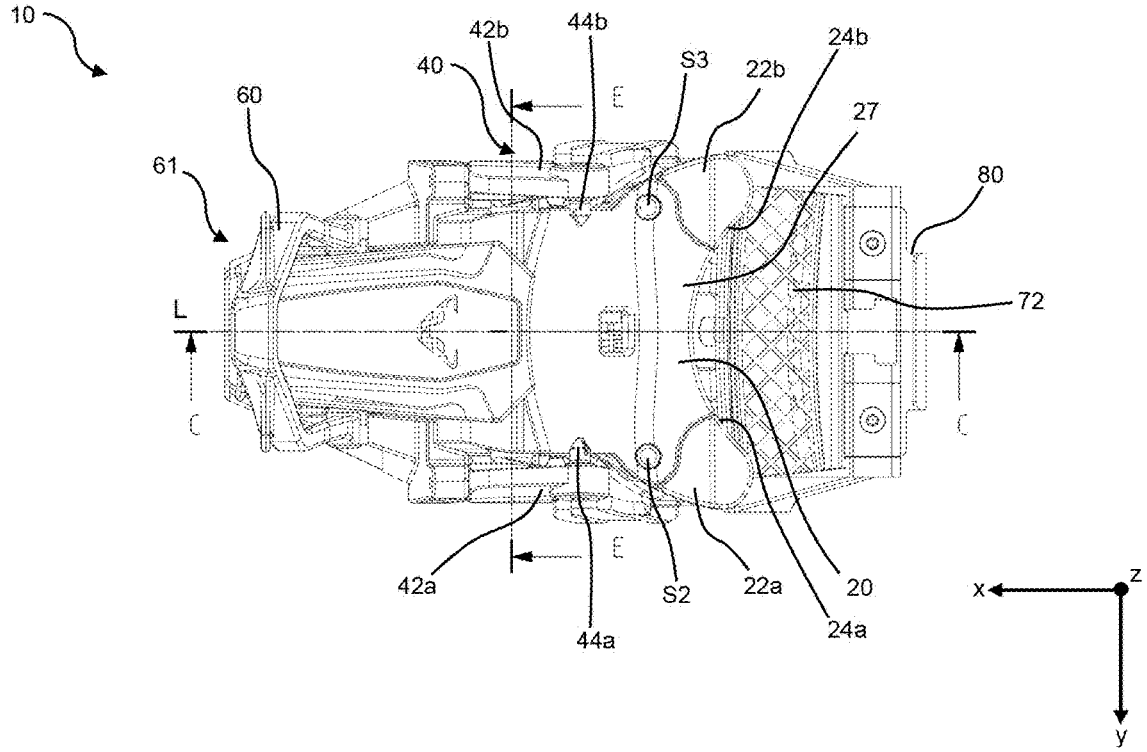
Figure 5:
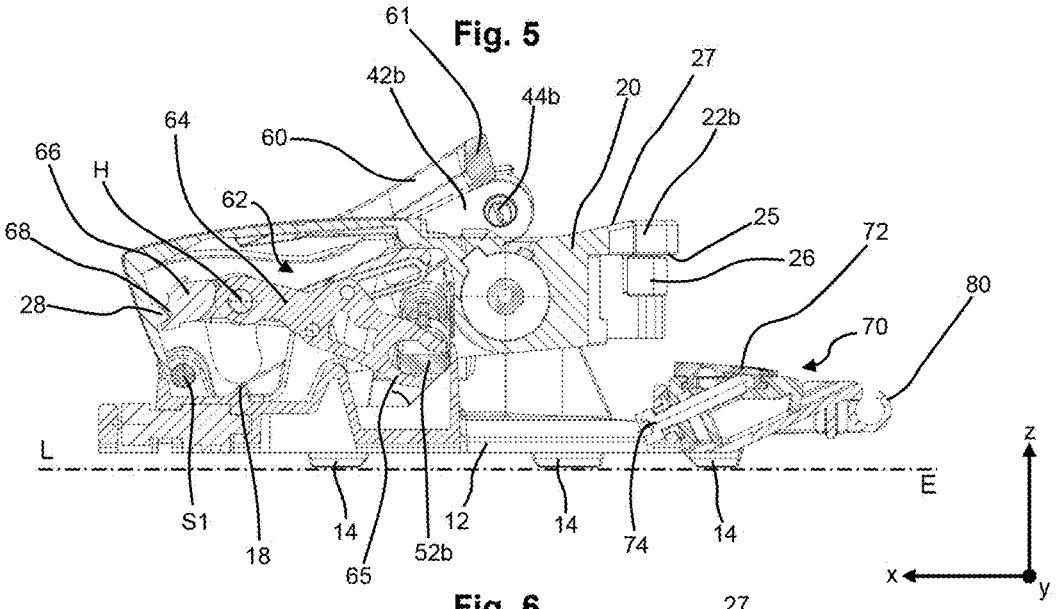
Figure 6:
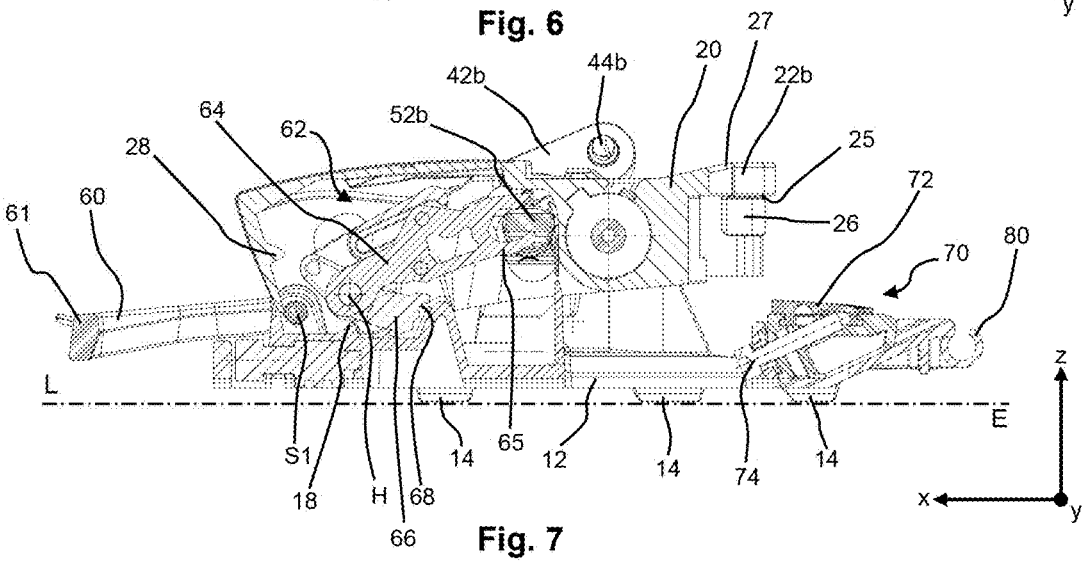
Figure 7:
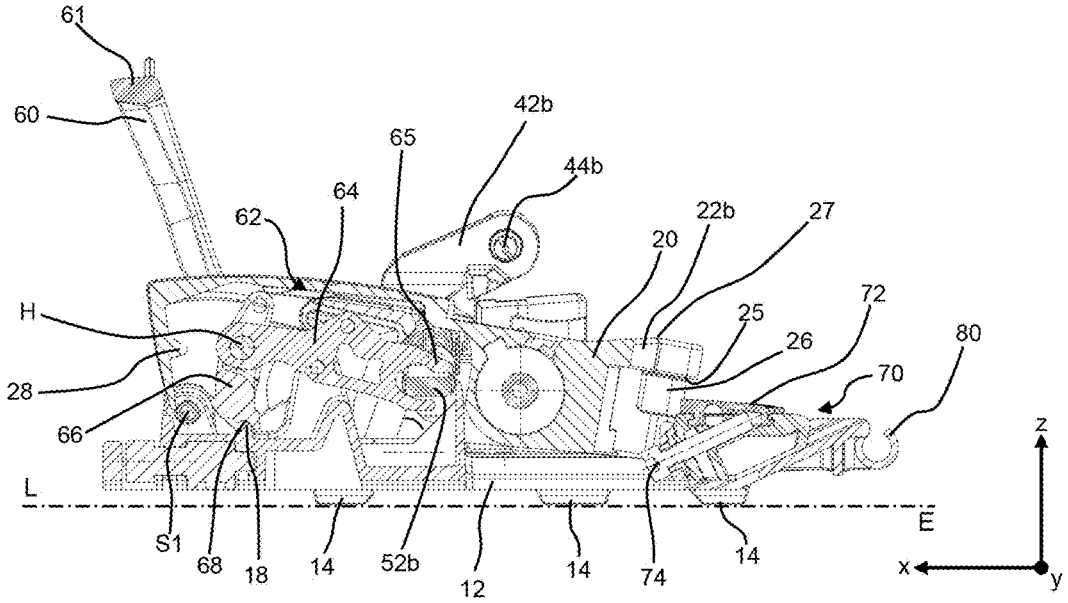
Figure 8:
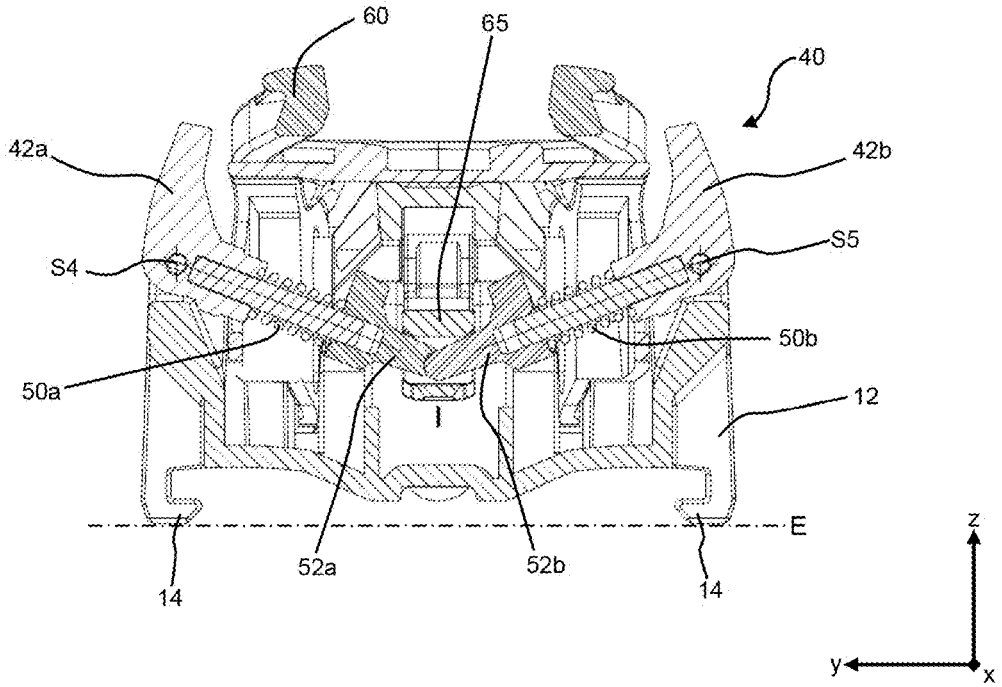
Figure 9:
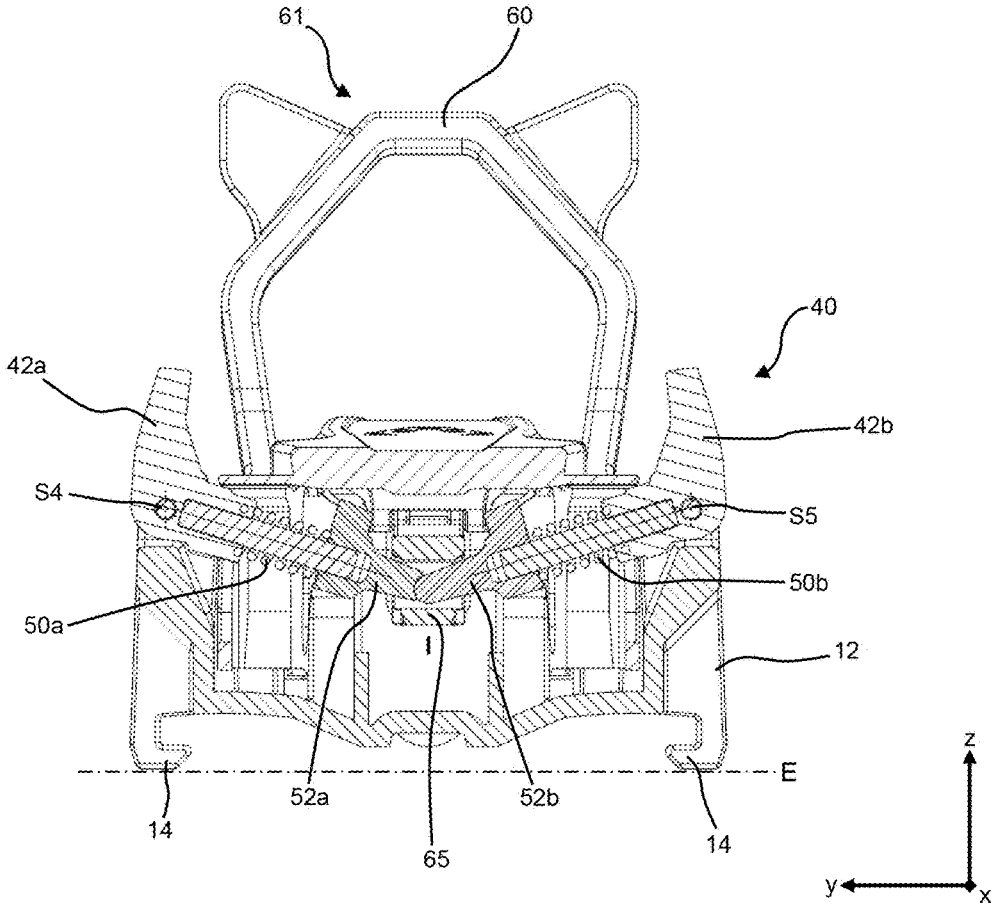
Figure 10:
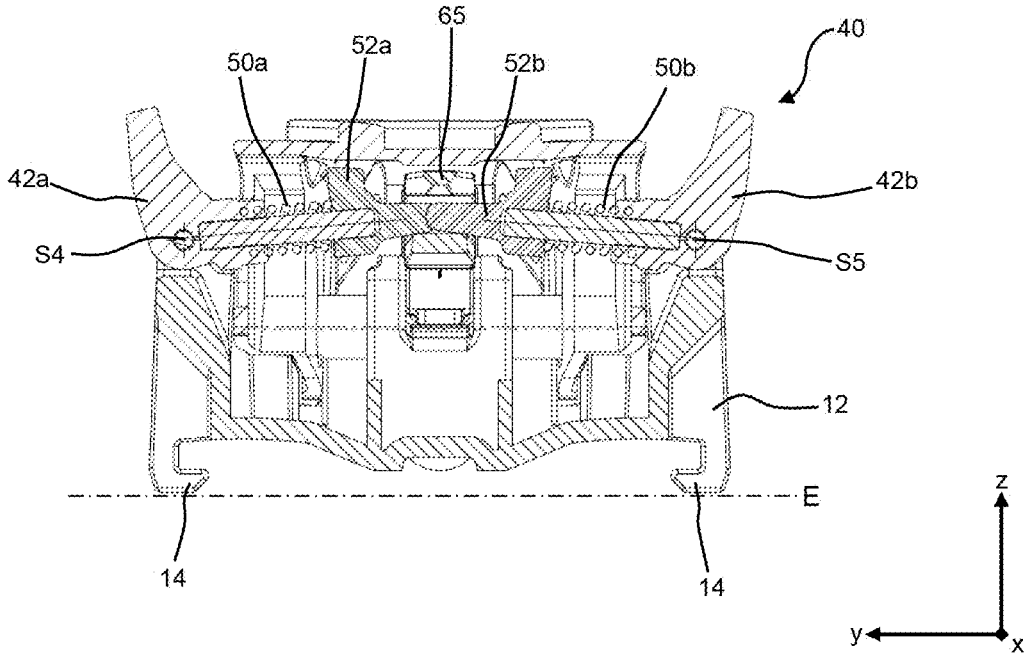
Figure 11:
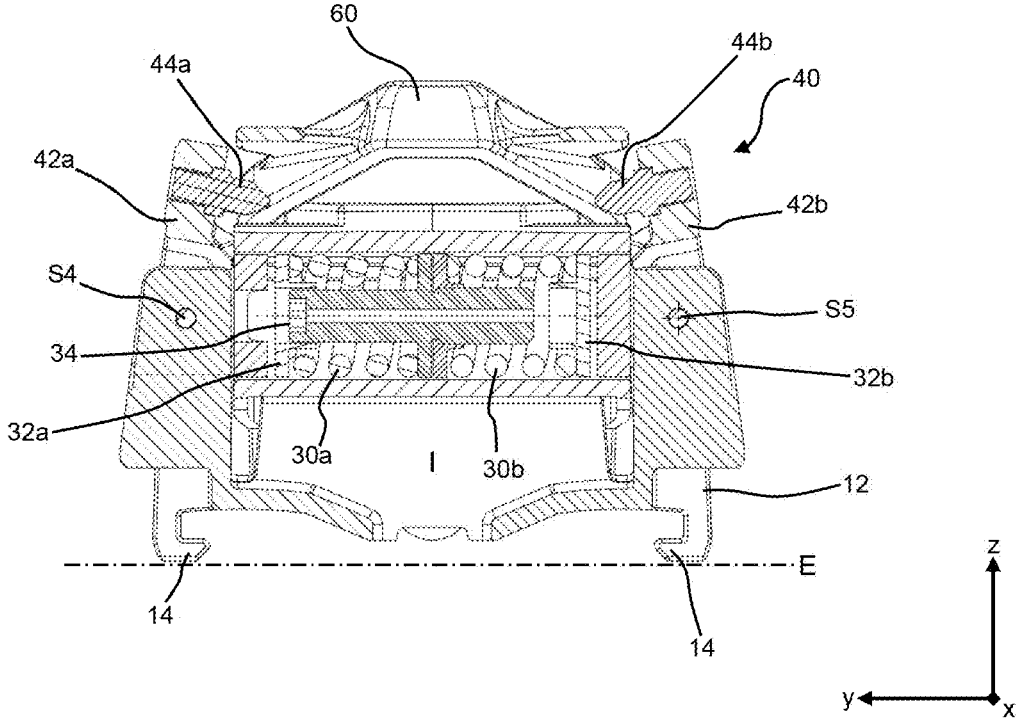

The invention is explained in more detail below on the basis of a preferred embodiment and with reference to the accompanying drawings. In the drawings, in detail:

FIG. 1 shows a perspective view of a front unit according to the preferred embodiment, in a downhill configuration, FIG. 2 shows a plan view of the front unit according to the preferred embodiment in the downhill configuration, FIG. 3 shows a plan view of the front unit according to the preferred embodiment in a starting configuration, FIG. 4 shows a plan view of the front unit according to the preferred embodiment in a climbing configuration, FIG. 5 shows a sectional view of the front unit according to the preferred embodiment of the present invention in the downhill configuration, along the line A-A in FIG. 2, FIG. 6 shows a sectional view of the front unit according to the preferred embodiment of the present invention in the starting configuration, along the line B-B in FIG. 3, FIG. 7 shows a sectional view of the front unit according to the preferred embodiment of the present invention in the climbing configuration, along the line C-C in FIG. 4, FIG. 8 shows a sectional view of the front unit according to the preferred embodiment of the present invention in the downhill configuration, along the line D-D in FIG. 2, FIG. 9 shows a sectional view of the front unit according to the preferred embodiment of the present invention in the climbing configuration, along the line E-E in FIG. 4, FIG. 10 shows a sectional view of the front unit according to the preferred embodiment of the present invention in the starting configuration, along the line F-F in FIG. 3, and FIG. 11 shows a sectional view of the front unit according to the preferred embodiment of the present invention in the downhill configuration, along the line G-G in FIG. 2.

With reference to FIG. 1, a front unit for a touring binding is generally denoted by 10. FIG. 1 is a perspective view of the front unit in a downhill configuration. A mounting surface of the front unit 10 which points in the direction of a sliding board surface of a sliding board, on which the front unit 10 is to be mounted, defines a sliding board plane E. Furthermore, a X-axis (sliding board longitudinal direction or x-direction) extending along a sliding board longitudinal axis L, which is oriented in the direction of travel of the sliding board, a Y-axis (sliding board transverse direction or y-direction) extending orthogonally to the X-axis and in parallel with the sliding board plane E, and a Z-axis extending orthogonally to the sliding board plane E (vertical direction or z-direction) are defined hereby.

In particular, the front unit 10 can comprise a base 12, the underside of which defines the sliding board plane E. In the embodiment described, the base 12 can in particular be in the form of a carriage 12 which can be displaced in the longitudinal direction of the sliding board by means of overlap portions 14 on a base plate (not shown), in order to adjust the length of the touring binding and thus to be able to adapt to different sole lengths, the base plate being able to be fixedly mounted on the sliding board, for example by means of binding screws.

The front unit 10 is adjustable between the downhill configuration shown in FIG. 1 (see for example also FIG. 2) and a climbing configuration (see for example FIG. 4), and comprises a first holding device 20 and a second holding device 40.

The first holding device 20 is designed, in the downhill configuration of the front unit 10, to fix a front portion of a sliding board boot to the touring binding for a descent. In addition, the first holding device 20 is adjustable between an active position and a passive position, the first holding device 20 being set into the active position in the downhill configuration of the front unit 10, and being set into the passive position in the climbing configuration of the front unit 10. In this case, an essential concept of the invention is that the first holding device 20 is arranged closer to the sliding board plane E in the passive position than in the active position, i.e., is arranged lower, in relation to a direction perpendicular to the sliding board plane E, in the climbing configuration of the front unit 10 than in the downhill configuration of the front unit 10. In the present embodiment, this can be achieved in that the first holding device 20 can be mounted so as to be pivotable about a hinge pin S1 that is substantially in parallel with the sliding board plane E 20) and substantially perpendicular to the sliding board longitudinal axis L, in particular on the base or the carriage 12 of the front unit 10, such that the first holding device can be lowered by a pivoting movement about this horizontal hinge pin S1 and thus can be adjustable from the active position into the passive position.

With reference to FIGS. 2 to 4, which are plan views of the front unit 10 in the downhill configuration (FIG. 2), a starting configuration (FIG. 3) and the climbing configuration (FIG. 4), the first holding device 20 can comprise two clamping jaws 22*a*, 22*b* having contact surfaces 24*a*, 24*b* which are designed to come into contact with a front portion of the sliding board boot in order to retain the sliding board boot when the front unit 10 is set into the downhill configuration and the first holding device 20 is set into the active position. In particular, a left-hand clamping jaw 22*a* in the direction of travel x can be mounted on the first holding device 20 so as to be pivotable about a swivel pin S2 that is substantially perpendicular to the sliding board plane E, and a right-hand clamping jaw 22*b* in the direction of travel x can be mounted on the first holding device 20 so as to be pivotable about a swivel pin S3 that is substantially perpendicular to the sliding board plane E. With reference to FIG. 11, which will be described in more detail later, the clamping jaws 22*a*, 22*b* can be biased by at least one spring 30*a*, 30*b* in such a way that they securely hold the sliding board boot.

In FIGS. 2 to 4, it can also be seen that the first holding device 20 in the present embodiment can be arranged further back than the second holding device 40 in a direction of travel x in parallel with the sliding board longitudinal axis L. That is to say that the first holding device 20 can be arranged closer to a heel unit (not shown) of the touring binding than the second holding device 40. The distances between the first holding device 20, the second holding device 40, and the heel unit (not shown) can in particular be fixed in such a way that a heel portion of the sliding board boot can be coupled to the heel unit in the downhill configuration of the front unit 10 during a descent with the touring binding and, when climbing with the touring binding in the climbing configuration of the front unit 10, is not disturbed by the heel unit.

The second holding device 40 is designed to secure a toe portion of the sliding board boot, for ascent with the touring binding, in the climbing configuration of the front unit 10 in such a way that the sliding board boot can be pivoted about a hinge pin that is substantially in parallel with the sliding board plane E and substantially perpendicular to the sliding board longitudinal axis L. FIGS. 5, 6 and 7 show that the second holding device 40 can also be adjustable between an active position and a passive position, it being set into the active position in the climbing configuration of the front unit 10 and being set into the passive position in the step-in configuration of the front unit 10. By means of the step-in configuration of the front unit 10, it is possible for a user to couple their boot to the second holding device 40. FIG. 5 is a sectional view along the line A-A in FIG. 2, i.e., the front unit 10 is shown in the downhill configuration, FIG. 6 is a sectional view along the line B-B in FIG. 3, i.e., the front unit 10 is shown in the step-in configuration, and FIG. 7 is a sectional view along the line C-C in FIG. 4, i.e., the front unit 10 is shown in the climbing position.

The second holding device 40 can comprise two arms 42*a*, 42*b* that are pivotably mounted on the base 12. In the described embodiment, the two arms 42*a*, 42*b* can be mounted about hinge pins S4, S5 that are substantially in parallel with the sliding board longitudinal axis L, but alternatively it would also be conceivable for the two arms 42*a*, 42*b* to be mounted on the base 12 of the front unit 10 so as to be pivotable about hinge pins that are substantially in parallel with the sliding board plane E and substantially perpendicular to the sliding board longitudinal axis L, or that only one of the arms is pivotably mounted and the other is rigidly connected to the base 12 or is integrally formed thereon.

The pivotable mounting of the arms 42*a*, 42*b* can advantageously ensure that the two arms 42*a*, 42*b* of the second holding device 40 can be moved between a closed position and an open position in order to couple and decouple the sliding board boot. The closed position and the open position are described in more detail later with reference to FIGS. 8 to 10.

A left-hand arm 42*a* of the two arms 42*a*, 42*b* in the direction of travel x can have a left-hand holding means 44*a*, and a right-hand arm 42*b* of the two arms 42*a*, 42*b* in the direction of travel x can have a right-hand holding means 44*b*. These holding means 44*a*, 44*b* can in particular be projections 44*a*, 44*b* which are designed to engage in receptacles provided on the sliding board boot. Conversely, it would also be conceivable for the holding means to be receptacles which are designed to be engaged by projections provided on the sliding board boot. In the present embodiment, the holding means 44*a*, 44*b* can in particular be designed as bearing journals 44*a*, 44*b* having conically tapered tips, which engage in corresponding opposite lateral bearing recesses of a sliding board boot. The front unit 10 can then be used in the climbing configuration when the sliding board boot is held on the bearing pin, and can be used in the downhill configuration when the first holding device 20 immovably fixes the front portion of the sliding board boot. In the downhill configuration, the bearing journals 44*a*, 44*b* are then in particular not in engagement with the bearing recesses of the sliding board boot. Accordingly, the described holding means 44*a*, 44*b* can pivotably hold the sliding board boot in the climbing configuration of the front unit 10.

FIGS. 5, 6 and 7 are sectional views of the front unit 10, FIG. 5 being a sectional view along the line A-A in FIG. 2, FIG. 6 being a sectional view along the line B-B in FIG. 3, and FIG. 7 being a sectional view along the line C-C in FIG. 4. Accordingly, the front unit is set into the downhill configuration in FIG. 5, set into the starting configuration in FIG. 6, and set into the climbing configuration in FIG. 7.

As shown, the clamping jaw 22*b* can have a contact roller 26 and/or a holding projection 25 in addition to the contact surface 24*b* or as a contact surface. This also applies in the same way to the clamping jaw 22*a*, which is not shown in the sectional views from FIGS. 5 to 7. In the downhill configuration of the front unit 10, in the active position of the first holding device 20, the holding projection 25 can overlap or hold down a front portion of the sliding board boot, in order to be able to hold the sliding board boot even more securely in the downhill configuration. The contact roller is designed for contact with a front portion of the sliding board boot, and supports a relative movement between the sliding board boot and the clamping jaws during a release of the sliding board boot in the event of a fall release. The contact roller(s) 26 can thus provide for a reduction in friction in the contact region between the sliding board boot and the front unit 10.

On its side facing away from the sliding board, the first holding device 20 can comprise a tread surface 27 for a sole portion of the sliding board boot. A user can adjust the first holding device 20 from the active position (see FIGS. 5 and 6) into the passive position (see FIG. 7) by stepping onto the tread surface 27 with a sole portion of the sliding board boot. In addition, by stepping onto the tread surface 27 of the first holding device 20, the second holding device 40 can also be adjusted from the passive position (FIG. 6) into the active position (FIG. 7). It is thereby possible for the user to only have to step with the sole portion of the sliding board boot onto the tread surface 27 of the first holding device 20, in order to bring the sliding board boot and the second holding device 40 into engagement. In the embodiment described, the first holding device 20 can in particular be provided in the manner of a housing 20 which can be pivoted about the hinge pin S1 and in which a toggle lever system 62 (described below) is accommodated and on which the clamping jaws 22*a*, 22*b* are pivotably mounted about the hinge pins S2, S3.

It can be clearly seen in FIG. 7 that the first holding device 20 is arranged significantly lower in its passive position than in its active position shown in FIGS. 5 and 6. It is thereby possible to couple the sliding board boot to the second holding device 40, in particular to the bearing means 44*a*, 44*b* of the arms 42*a*, 42*b*, without the first holding device 20 causing disruption.

The toggle lever system 62 already mentioned above can be part of a lever assembly 60, 62, as a deflection mechanism 62, which assembly further comprises an opening lever 60 which has an in particular exposed actuating portion 61. The opening lever 60 can in particular be pivotable about a lever axis H which is in parallel with the sliding board plane E and perpendicular to the sliding board longitudinal axis L, and can be adjustable by a pivoting movement about the lever axis H between a downhill position (FIG. 5), a step-in position (FIG. 6) and a climbing position (FIG. 7). By adjusting the opening lever 60 between the downhill position, the step-in position and the climbing position, by operating the actuating portion 61, the front unit 10 can be adjusted between the downhill configuration, the step-in configuration and the climbing configuration. As can be seen, in the present embodiment in FIG. 5, the opening lever 60 is located in the downhill configuration, in a position approximated to the first holding device 20, in FIG. 6 in the step-in configuration, in a position that is approximated to the sliding board, and in FIG. 7 in the climbing configuration, in an upwardly projecting position, but other lever positions are also conceivable for the different configurations. In particular, the opening lever 60 can be pivoted about the swivel pin H at an angle of more than 90°, preferably more than 120°, or even more than 150°, in order to be able to provide the above-described angular positions of the opening lever 60.

By means of the toggle lever system 62, an adjusting movement of the opening lever 60 via a clamping mechanism 50*a*, 50*b*, 52*a*, 52*b* (described below) can in particular be transmitted via an adjusting lever 64 to the arms 42*a*, 42*b* of the second holding device 40, so that an opening angle of the arms 42*a*, 42*b* relative to one another is greater in the step-in configuration than in the downhill configuration and the climbing configuration (see also FIGS. 8 to 10). For this purpose, the adjusting lever 64 can comprise an end-side fork portion 65 which encompasses spring stops 52*a*, 52*b* of the clamping mechanism. A more detailed mode of operation will be described later with reference to FIGS. 8 to 10.

The lever assembly 60, 62 can furthermore be designed to block the first holding device 20 in the active position, in the downhill position of the opening lever 60, in order to stabilize said holding device in the active position. For this purpose, the toggle lever system 62 can comprise a locking lever 66 which has a latching recess 68. The locking lever 66 can be formed integrally with the opening lever 60, as a locking portion 66 of the opening lever 60 on an end of the opening lever 60 opposite the actuating portion 61. Alternatively, the locking lever 66 can be rigidly connected to or immovable in relation to the opening lever 60, as a separate component. A latching projection 18 formed complementarily to the latching recess 68 can be provided on an inside portion of the first holding device 20, designed in particular as a pivotable housing, and can engage with the latching recess 68 in the downhill configuration of the front unit 10 and the downhill position of the opening lever 60, in order to lock the first holding device 20 or to block it in its active position (see FIG. 5).

The deflection mechanism 62 can in particular be designed such that the latching portion 68 can pivot in front of and behind the complementary latching portion 18 in relation to the direction x, in parallel with the sliding board longitudinal axis L, so that it can pivot in both directions beyond the latched position with the latching portion 18 on the base 12.

In the preferred embodiment of the present invention, an adjustment of the opening lever 60 from the step-in position into the downhill position takes place in such a way that the latching portion 68 of the locking lever 66, starting from the climbing position, pivots beyond the complementary latching portion 18 on the base 12. As mentioned above, the adjusting movement of the opening lever 60 is transmitted to the second holding device 40 in order to effect a movement of the arms 42*a*, 42*b* of the second holding device 40 relative to one another, in particular in order to change the opening angle of the arms 42*a*, 42*b*. As a result, the distance between the holding means 44*a*, 44*b* provided in each case on the arms 42*a*, 42*b* also changes. In the step-in position of the opening lever 60, this distance is greater than a width of the sliding board boot at the point to be coupled, such that the boot can be guided between the holding means 44*a*, 44*b*. In the climbing position of the opening lever 60, the distance between the holding means 44*a*, 44*b* is somewhat smaller than the boot width at the point to be coupled, so that the sliding board boot is clamped firmly. In the downhill configuration of the front unit 10 and the downhill position of the opening lever 60, as can be seen in FIG. 11 the distance between the holding means 44*a*, 44*b* can be set so small, by the continued movement of the opening lever 60 beyond the latching position, that the sliding board boot cannot be coupled to the second holding device 40, but only to the first holding device 20, which is intended for the descent.

Furthermore, a latching projection 18 which is designed in a manner complementary to the latching recess 68 can also be formed on the base 12, which latching projection can engage with the latching recess 68 in the climbing configuration of the front unit 10 and the climbing position of the opening lever 60, in order to lock the second holding device 40 or to block it in its active position (see FIG. 7).

FIGS. 5 to 7 furthermore show a tread portion 70 which has a tread plate 72 for a sole portion of the sliding board boot. The tread portion 70 can be mounted on the base 12 or on the sliding board and can support the sole portion of the sliding board boot on the tread plate 72 at a predetermined height above the sliding board plane E. In particular, the tread plate 70 can be designed to move in a direction y, that is substantially in parallel with the sliding board plane E and substantially perpendicular to the sliding board longitudinal axis L, in the case of a lateral release of the first holding device 20. As a result, in the event of a lateral release (Mz release), less friction occurs between the sole portion of the sliding board boot and the portion of the front unit 10 on which the sole portion of the sliding board boot is supported. For example, the tread plate 72 can be height-adjustable by an adjusting screw 74, such that a distance between the tread plate 72 and the sliding board plane E can be changed. A variable distance between the sliding board plane E and the tread plate 72 of the tread portion 70 makes it possible for the front unit 10 to be adapted for different sole profiles or sole thicknesses. An adjustment of the height of the tread plate 72 above the sliding board plane E can take place in a relatively simple manner, for example by means of the adjusting screw 74, the height of the tread plate 72 being able to be changed by a rotation of the screw 74.

In addition, a frozen snow lug 90 can be fastened to the tread portion 70 or to the sliding board itself, for example by means of screws, for receiving frozen snow.

The mode of operation of the second holding device 40 is described in more detail below with reference to FIGS. 8, 9 and 10. FIG. 8 is a sectional view of the front unit 10 in the downhill configuration, along the line D-D in FIG. 2, FIG. 9 is a sectional view of the front unit 10 in the climbing configuration, along the line E-E in FIG. 4, and FIG. 10 is a sectional view of the front unit 10 in the step-in configuration, along the line F-F in FIG. 3.

The second holding device 40 can comprise a clamping mechanism 42*a*, 42*b*, 50*a*, 50*b*, 52*a*, 52*b*, which can be formed from the two arms 42*a*, 42*b*, a resilient element, for each arm 42*a*, 42*b*, in each case, in the form of compression springs 50*a*, 50*b*, and a spring stop in each case for each spring 50*a*, 50*b*. The clamping mechanism 42*a*, 42*b*, 50*a*, 50*b*, 52*a*, 52*b* biases the second holding device 40 into the active position and/or into the passive position, it being possible in particular for a dead centre to be passed through during the adjustment between the active position and the passive position, so that the second holding device 40 is always biased by the clamping mechanism, either into the active position (see for example FIG. 9) or into the passive position (see FIG. 10). As mentioned above, in this case an opening angle of the arms 42*a*, 42*b* relative to one another is greater in the step-in configuration of the front unit 10 (FIG. 10) than in the downhill configuration of the front unit 10 (FIG. 8) and the climbing configuration of the front unit 10 (FIG. 9).

The compression springs 50*a*, 50*b* can be wound around end portions of the arms 42*a*, 42*b* facing one another and can press against the spring stops 52*a*, 52*b* at one spring end, and press at the respectively opposite spring ends against a stepped portion of the arms 42*a*, 42*b* in each case, in order to bias the second holding device 40 or the arms 42*a*, 42*b*. During an adjustment from the climbing configuration (active position—FIG. 9) into the step-in configuration (passive position—FIG. 10), a dead centre is passed through in a substantially horizontal position of the mutually facing arm end portions, in which dead centre the clamping forces of the clamping mechanism are substantially cancelled, so that the second holding device 40 can be biased, both in the passive position and in the active position, into this position in each case. For the adjustment between the active position and the passive position of the second holding device 40 or the arms 42*a*, 42*b* by means of the opening lever 60, as described above an end-side fork portion 65 of the adjusting lever 64 of the toggle lever system 62 of the lever assembly 60, 62 can surround the spring stops 52*a*, 52*b* of the clamping mechanism of the second holding device 40. A pivoting movement of the opening lever 60 about the lever axis H can thereby be converted into a substantially vertical movement, upwards and downwards, of the spring stops 52*a*, 52*b*, and thus into a pivoting movement of the arms 42*a*, 42*b* about the hinge pins S4, S5, in order to adjust the second holding device 40 between the active position and the passive position.

With reference to FIG. 11, a release mechanism of the first holding device 20 of the front unit 10 according to the present embodiment is described below. FIG. 11 is a sectional view of the front unit 10 in the downhill configuration, along the line G-G in FIG. 2.

The first holding device 20 can comprise a release mechanism 22*a*, 22*b*, 30*a*, 30*b*, 32*a*, 32*b*, 34 having at least one resilient element 30*a*, 30*b*. In the present embodiment, two compression springs 30*a*, 30*b* can be provided as a resilient element, which press against spring guides 32*a*, 32*b* and the spring bias of which can be changed, for example by means of an adjusting screw 34, in order to be able to adjust a release force.

The release mechanism 22*a*, 22*b*, 30*a*, 30*b*, 32*a*, 32*b*, 34 biases the first holding device 20 in a holding position, in that the spring force of the springs 30*a*, 30*b* is transmitted to the clamping jaws 22*a*, 22*b* in such a way that these are biased in one direction, relative to one another. In the holding position, the first holding device 20 holds the front portion of the sliding board boot firmly by means of the clamping jaws 22*a*, 22*b* and, when a predetermined release force acting on the contact surfaces 24*a*, 24*b* of the clamping jaws 22*a*, 22*b*, which can be set by a change in the bias of the springs 30*a*, 30*b*, is exceeded, the first holding device 20 is brought into a release position, in which the front portion of the sliding board boot is released, in particular by the contact surfaces 24*a*, 24*b* of the clamping jaws 22*a*, 22*b* being pivoted away from one another about the hinge pins S2, S3. In the present embodiment, the release mechanism 22*a*, 22*b*, 30*a*, 30*b*, 32*a*, 32*b*, 34 can in particular be a Mz release mechanism.

The invention claimed is:

1. A front unit for a touring binding, which is to be mounted on a sliding board and has a mounting surface that points in the direction of a sliding board surface and defines a sliding board plane, the front unit being adjustable between a downhill configuration and a climbing configuration, comprising:

a first holding device which is configured, in the downhill configuration of the front unit, to fix a front portion of a sliding board boot to the touring binding for a descent, the first holding device being adjustable between an active position and a passive position, and the first holding device being set into the active position in the downhill configuration of the front unit and being set into the passive position in the climbing configuration of the front unit, wherein the first holding device is arranged closer to the sliding board plane in the passive position than in the active position;

a second holding device which is configured to secure a toe portion of the sliding board boot, for ascent with the touring binding, in the climbing configuration of the front unit, in such a way that the sliding board boot is pivotable about a hinge pin that is substantially in parallel with the sliding board plane and substantially perpendicular to a sliding board longitudinal axis, wherein the second holding device comprises two arms which are pivotably mounted on a base of the front unit and have holding means which are configured to pivotally hold the sliding board boot in the climbing configuration of the front unit, and wherein an opening angle of the arms of the second holding device relative to one another in a starting configuration of the front unit is greater than in the downhill configuration of the front unit and/or the climbing configuration of the front unit; and a lever assembly comprising an opening lever and a deflection mechanism, wherein the opening lever has an actuating portion and is adjustable by means of the actuating portion between a downhill position, a starting position, and a climbing position and the lever assembly is configured to adjust the front unit between the downhill configuration, a starting configuration, and the climbing configuration by means of an adjustment of the opening lever between the downhill position, the starting position and the climbing position, wherein the deflection mechanism comprises a locking lever, which is formed in one piece with the opening lever or is immovable relative to the opening lever, and an adjusting lever which is connected to the opening lever and/or the locking lever and which is configured to transmit an adjusting movement of the opening lever to the second holding device in order to effect a movement of the arms of the second holding device relative to one another to modify the opening angle of the arms, wherein one end of the locking lever has a latching portion which is configured to engage with a complementary latching portion provided on the base of the front unit in the climbing position of the opening lever, in order to lock the second holding device in the active position, in the climbing position of the front unit, and wherein the opening lever is pivotably mounted about a swivel pin in such a way that the latching portion is able to pivot in front of and behind the complementary latching portion in relation to a direction in parallel with the sliding board longitudinal axis.

2. The front unit of claim 1, wherein the first holding device is mounted on the base of the front unit so as to be pivotable about an axis of rotation which is substantially in parallel with the sliding board plane and is substantially perpendicular to the sliding board longitudinal axis.

3. The front unit of claim 1, wherein the first holding device comprises two clamping jaws which have contact surfaces which are configured to come into contact with the front portion of the sliding board boot in order to securely hold the sliding board boot when the front unit is set into the downhill configuration and the first holding device is set into the active position.

4. The front unit of claim 1, wherein the second holding device is adjustable between an active position and a passive position and is set into the active position in the climbing configuration of the front unit and is set into the passive position in a starting configuration of the front unit.

5. The front unit of claim 4, wherein the first holding device comprises a tread surface for a sole portion of the sliding board boot on its side facing away from the sliding board; and wherein the front unit is configured such that, by stepping onto the tread surface of the first holding device with the sole portion of the sliding board boot, the first holding device is adjusted from the active position to the passive position, and/or the second holding device is adjusted from the passive position into the active position.

6. The front unit of claim 1, wherein the two arms of the second holding device are mounted on the base of the front unit so as to be pivotable about hinge pins that are substantially in parallel with the sliding board longitudinal axis or about hinge pins that are substantially in parallel with the sliding board plane and substantially perpendicular to the sliding board longitudinal axis.

7. The front of claim 1, wherein the first holding device is arranged further back, in a direction of travel in parallel with the sliding board longitudinal axis, than the second holding device.

8. The front unit of claim 1, wherein the opening lever is pivotably mounted about a swivel pin; and wherein the pivot angle of the opening lever is at least approximately 90°.

9. The front unit of claim 1, wherein the lever assembly is further configured to block the first holding device in the active position, in the downhill position of the opening lever.

10. The front of claim 1, wherein the first holding device comprises a release mechanism having at least one resilient element; and wherein the release mechanism is configured to bias the first holding device into a holding position in which the first holding device securely holds the front portion of the sliding board boot, and, when a predetermined release force acting on the first holding device is exceeded, to bring the first holding device into a release position in which the front portion of the sliding board boot is released.

11. The front of claim 1 wherein, the second holding device comprises a clamping mechanism having at least one resilient element; and wherein the clamping mechanism is configured to bias the second holding device into the active position and/or into the passive position.

12. The front of claim 1, further comprising:

a tread portion having a tread plate for a sole portion of the sliding board boot, wherein the tread portion is mounted on the base of the front unit or on the sliding board and is configured to support the sole portion of the sliding board boot on the tread plate at a predetermined height above the sliding board plane.

13. The front unit of claim 12, wherein the tread plate is height-adjustable in such a way that a distance between the tread plate and the sliding board plane can be changed.

14. A touring binding comprising:

a heel unit; and a front unit mounted on a sliding board and having a mounting surface that points in the direction of a sliding board surface to define a sliding board plane, the front unit being adjustable between a downhill configuration and a climbing configuration, wherein the front unit further comprises:

a first holding device configured, in the downhill configuration of the front unit, to fix a front portion of a sliding board boot to the touring binding for a descent, the first holding device being adjustable between an active position and a passive position, and the first holding device being set into the active position in the downhill configuration of the front unit and being set into the passive position in the climbing configuration of the front unit, wherein the first holding device is arranged closer to the sliding board plane in the passive position than in the active position;

a second holding device configured to secure a toe portion of the sliding board boot, for ascent with the touring binding, in the climbing configuration of the front unit, in such a way that the sliding board boot is pivotable about a hinge pin that is substantially in parallel with the sliding board plane and substantially perpendicular to a sliding board longitudinal axis, wherein the second holding device comprises two arms which are pivotably mounted on a base of the front unit and have holding means which are configured to pivotally hold the sliding board boot in the climbing configuration of the front unit, and wherein an opening angle of the arms of the second holding device relative to one another in a starting configuration of the front unit is greater than in the downhill configuration of the front unit and/or the climbing configuration of the front unit; and;

a lever assembly comprising an opening lever and a deflection mechanism, wherein the opening lever has an actuating portion and is adjustable by means of the actuating portion between a downhill position, a starting position, and a climbing position and the lever assembly is configured to adjust the front unit between the downhill configuration, a starting configuration, and the climbing configuration by means of an adjustment of the opening lever between the downhill position, the starting position and the climbing position, wherein the deflection mechanism comprises a locking lever, which is formed in one piece with the opening lever or is immovable relative to the opening lever, and an adjusting lever which is connected to the opening lever and/or the locking lever and which is configured to transmit an adjusting movement of the opening lever to the second holding device in order to effect a movement of the arms of the second holding device relative to one another to modify the opening angle of the arms, wherein one end of the locking lever has a latching portion which is configured to engage with a complementary latching portion provided on the base of the front unit in the climbing position of the opening lever, in order to lock the second holding device in the active position, in the climbing position of the front unit, and wherein the opening lever is pivotably mounted about a swivel pin in such a way that the latching portion is able to pivot in front of and behind the complementary latching portion in relation to a direction in parallel with the sliding board longitudinal axis.

15. The touring binding claim 14, further comprising a brake assembly.

16. The front unit of claim 1, wherein the opening lever is pivotably mounted about a swivel pin, and the pivot angle of the opening lever is at least approximately 150°.

17. The front unit of claim 12, wherein the tread plate is configured to move in a direction that is substantially in parallel with the sliding board plane and substantially perpendicular to the sliding board longitudinal axis, in case of a lateral release of the first holding device.

* * * * *